US008957647B2

(12) United States Patent
Yang

(10) Patent No.: US 8,957,647 B2
(45) Date of Patent: Feb. 17, 2015

(54) SYSTEM AND METHOD FOR VOLTAGE REGULATION USING FEEDBACK TO ACTIVE CIRCUIT ELEMENT

(75) Inventor: Robit Yang, Daxi (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 316 days.

(21) Appl. No.: 12/950,090

(22) Filed: Nov. 19, 2010

(65) Prior Publication Data

US 2012/0126763 A1 May 24, 2012

(51) Int. Cl.
*G05F 1/00* (2006.01)
*G05F 3/18* (2006.01)
*G05F 1/56* (2006.01)

(52) U.S. Cl.
CPC ... *G05F 3/18* (2013.01); *G05F 1/56* (2013.01)
USPC ..... 323/282

(58) Field of Classification Search
USPC ..... 323/273, 274, 278, 279, 280, 281, 313
See application file for complete search history.

(56) References Cited

U.S. PATENT DOCUMENTS

| | | | | |
|---|---|---|---|---|
| 4,633,162 | A | 12/1986 | Melbert | |
| 5,027,266 | A | 6/1991 | Ishii et al. | |
| 5,570,004 | A * | 10/1996 | Shibata | 323/303 |
| 5,621,307 | A * | 4/1997 | Beggs | 323/313 |
| 6,342,780 | B1 * | 1/2002 | Pickering | 323/313 |
| 6,570,437 | B2 | 5/2003 | Park et al. | |
| 6,670,845 | B1 * | 12/2003 | Fong | 327/541 |
| 7,030,598 | B1 | 4/2006 | Dow | |
| 7,053,596 | B2 * | 5/2006 | Koyasu | 323/313 |
| 7,205,827 | B2 * | 4/2007 | Leung et al. | 327/540 |
| 7,466,198 | B1 | 12/2008 | Hunter | |
| 7,525,294 | B2 * | 4/2009 | Messager | 323/274 |
| 8,193,854 | B2 * | 6/2012 | Kuang et al. | 327/539 |
| 2009/0080267 | A1 * | 3/2009 | Bedeschi et al. | 365/189.09 |
| 2009/0267585 | A1 * | 10/2009 | Liu et al. | 323/313 |
| 2010/0195358 | A1 * | 8/2010 | Erbito, Jr. | 363/84 |

OTHER PUBLICATIONS

Razavi, Design of Analog CMOS Integrated Circuits, McGraw-Hill, ISBN 0-07-118839-8, 2001, p. 308.

Allen, P. et al., CMOS Analog Circuit Design, Oxford University Press, ISBN 0-19-511644-5, 2002, Chapter 6, 6.2—"Compenstion of Op Amps", p. 258.

* cited by examiner

*Primary Examiner* — Adolf Berhane
*Assistant Examiner* — Afework Demisse
(74) *Attorney, Agent, or Firm* — Duane Morris LLP

(57) ABSTRACT

Systems and methods for voltage regulation provide close-tolerance voltage regulation over a wide input voltage range. A voltage regulator has a reference voltage unit, first and second transistors, and an active circuit element. The reference voltage unit is configured to provide a substantially constant voltage signal at a reference node. The first transistor is coupled to the reference node and to an input node having an input voltage. The active circuit element is coupled to the first transistor. The second transistor has a source coupled in feedback configuration to a first input of the active circuit element, a drain coupled to the input node, and a gate configured to be driven by the active circuit element to force the source to a voltage about equal to a voltage of a second input of the active circuit element independent of the input voltage.

20 Claims, 6 Drawing Sheets

SYSTEM AND METHOD FOR VOLTAGE REGULATION USING FEEDBACK TO ACTIVE CIRCUIT ELEMENT

BACKGROUND

Voltage regulation is an important aspect of various circuit applications. One type of known voltage regulator is a bandgap-referenced voltage circuit, which generates an output voltage near 1.25V, which is close to the theoretical 1.22 eV bandgap of silicon at 0 K. Bandgap voltage circuits are described at, e.g., U.S. Pat. No. 6,570,437 to Park. Another type of voltage regulator is a low drop-out (LDO) regulator, which is a DC linear voltage regulator that operates with a small input-output differential voltage. LDO regulators are described at, e.g., U.S. Pat. No. 7,030,598 to Dow.

An object of a voltage regulator is to maintain an accurately regulated output voltage notwithstanding variations in current loading of the voltage regulator output and variation of the unregulated input voltage to the voltage regulator. Known voltage regulators are not capable of effectively maintaining a closely regulated output voltage over a wide range of different or changing input voltages. Typically, conventional voltage regulator designs are based on a predetermined nominal specification input voltage and expected load current, within relatively limited tolerances, and generate internal voltages and regulated output power specifications therefrom. Consequently, if the input voltage changes (which may have a variety of reasons, including the desire to accommodate a range of applications), significant time and silicon verification testing may be expended. As a result, the time to market for products may be compromised.

BRIEF DESCRIPTION OF THE DRAWINGS

The following will be apparent from elements of the figures, which are provided for illustrative purposes and are not necessarily to scale.

DETAILED DESCRIPTION

This description of the exemplary embodiments is intended to be read in connection with the accompanying drawings, which are to be considered part of the entire written description.

Figure 1:
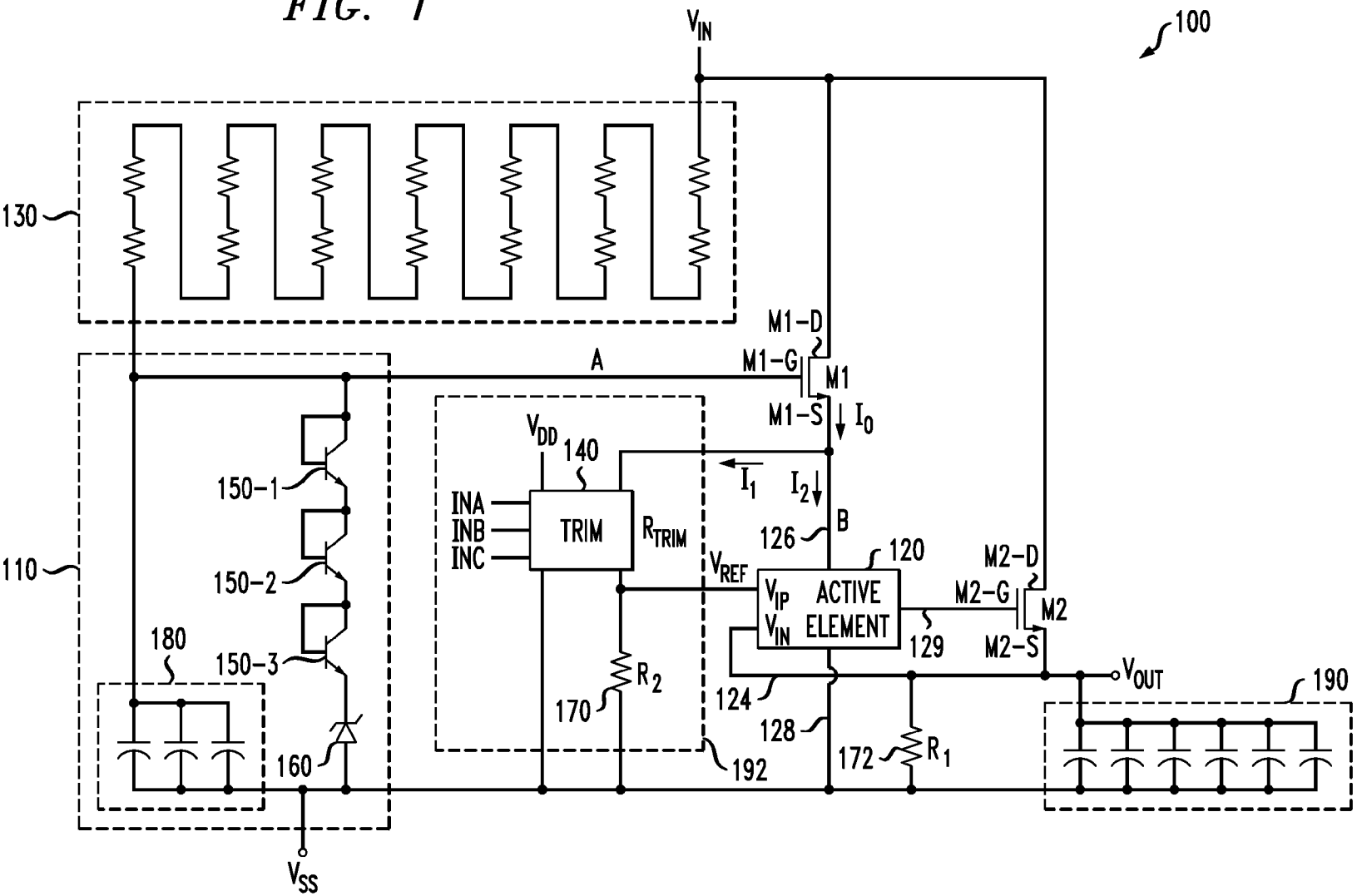
FIG. 1 is a block diagram of a voltage regulator in accordance with certain embodiments.

FIG. 1 is a block diagram of a voltage regulator in accordance with some embodiments. Voltage regulator 100 is configured to accommodate a wide range of input voltages (e.g., 10 to 60 V) while providing a substantially constant regulated output voltage with a relatively narrow range of output voltage variation (e.g., 5V±5%). Such a wide range of input voltages renders embodiments aptly suitable for a variety of applications, including LEDs, computers, car rear lights, bulbs, lamps, and communication devices. Generally, embodiments are suitable for various applications that involve stepping a higher voltage (e.g., an input voltage higher than 10V) to a lower voltage. Embodiments may be tailored to various output voltages depending on a reference voltage that is provided, further rendering embodiments suitable for diverse uses. For example, to obtain an output of 8V rather than 5V, an appropriate reference input may be supplied. For convenience, an output voltage of 5V (±5%) is described in the discussion below, although it is understood that various output voltages may be used.

Voltage regulator 100 includes a reference voltage unit 110, a first transistor M1, an active circuit element 120, and a second transistor M2. The active circuit element 120 may be an operational amplifier, e.g., a high-gain differential two-stage amplifier. Transistors M1 and M2 may be n-type metal oxide semiconductor (NMOS) transistors fabricated with the Taiwan Semiconductor Manufacturing Company (TSMC) BCD (Bipolar-CMOS-DMOS) process. The reference voltage unit 110 is configured to provide a substantially constant nonzero voltage signal at a reference node A. Transistors M1 and M2 operate as a first stage and a second stage, respectively, of a two-stage series regulator. Transistor M1 is coupled, e.g., at its gate M1-G, to reference node A and is coupled, e.g., at its drain M1-D, to an input node $V_{IN}$ having an input voltage. As used herein, "coupled" (or "connected") does not require direct connection but should be construed to include a situation in which there are intervening circuit elements. $V_{IN}$ may be a variable input voltage or may be a nonvariable voltage in a wide range of acceptable input voltages. In some embodiments, $V_{IN}$ may vary over a wide input range, e.g., 10V to 60V.

The active circuit element 120 receives a first input, denoted $V_{REF}$, and a second input 124, and is powered by a positive power supply input 126 and a negative power supply input 128, which may be a reference ground voltage $V_{SS}$. The active circuit element 120 is coupled to transistor M1. The active circuit element 120 may be configured to receive its first input $V_{REF}$ based on an output terminal (e.g., a source terminal M1-S) of transistor M1, and may be configured to be powered by that output terminal. A trim circuit 140 may be coupled between the source terminal M1-S and $V_{REF}$ and may provide trimming functionality to provide fine adjustments to $V_{REF}$, e.g., based on input signals INA, INB, and INC.

Transistor M2 may have a source M2-S coupled in feedback configuration to input $V_{IN}$ of the active circuit element 120, a drain M2-D coupled to the input node $V_{IN}$, and a gate M2-G configured to be driven by the active circuit element 120 to force the source M2-S to a voltage about equal to $V_{REF}$ independent of the variable input voltage $V_{IN}$. Embodiments may employ closed-loop gain-boosting feedback to provide a stable output voltage $V_{OUT}$. Voltage regulator 100 has good output impedance and a fast response time to maintain nearly constant output voltage.

In some embodiments, at least one resistor 130 is situated in a path between the input node $V_{IN}$ and reference node A. In the example of FIG. 1, fourteen resistors, each having a resistance of 1M Ohm, are shown in series, although other numbers may be used as well. Resistors 130 reduce leakage current and save power.

Reference voltage unit 110 may have at least one diode and at least one resistor coupled in series. In the example of FIG. 1, a zener diode 160 is coupled in series with bipolar junction transistors (BJTs) 150-1, 150-2, and 150-3 (collectively 150). Due to voltage drop across the zener diode 160 and the BJTs 150, the voltage at node A is $V_{zener}+3*V_{BE}$, where $V_{BE}$ is a base-to-emitter voltage. For example, $V_{zener}$ may be 5V and $V_{BE}$ may be 0.9V, yielding 7.7V (about 8V) at node A. Reference voltage unit 110 has one or more forward biased semiconductor junctions and one or more reverse biased semiconductor junctions.

Series resistors 130 and the zener diode 160 may have proportional to absolute temperature (PTAT) characteristics, i.e., voltage drop increases with increasing temperature. BJTs 150 may have complementary to absolute temperature (CTAT) characteristics, i.e., voltage drop reduces with increasing temperature. In other words, each diode in the reference voltage unit 110 has a temperature coefficient of a first sign (positive or negative), and each transistor in the reference voltage unit 110 has a temperature coefficient of a second sign (negative or positive) that is opposite the first sign. Consequently, node A is maintained at nearly constant voltage despite changes in temperature. Thus, the voltage provided to the gate M1-G is substantially constant, resulting in the source current of M1 being substantially constant, as discussed further below in the context of FIG. 5. As a result, the voltage $V_{REF}$ provided to the active circuit element 120 is substantially constant, and the output voltage $V_{OUT}$ is also substantially constant (e.g., within a tolerance of 5%), over a range of unregulated input voltages and process variation. Process variation (or variation in process corners related to the epitaxial process whereby the series regulator circuit is fabricated) refers to the fact that transistors, resistors, capacitors or any other circuit element may be fabricated in typical (TT), fast (FF) or slow (SS) modes. For example, fast corners may correspond to minimum capacitance and resistance to provide minimum delay and fastest speed (fastest performance), while slow corners may correspond to maximum capacitance and resistance to provide maximum delay and slowest speed.

The source current I0 of transistor M1 is equal to the sum of currents I1 and I2. Transistor M1 is biased by reference node A. The source current I1 has a value given by: $I1=(V_A-V_{GS1})/(R_{TRIM}+R_2)=(V_{IN}-V_{DS1})/(R_{TRIM}+R_2)$, where $V_A$ is the voltage at node A, $V_{GS1}$ is the gate-to-source voltage for transistor M1 (e.g., 0.7V), $V_{DS1}$ is the drain-to-source voltage for transistor M1, $R_{TRIM}$ is the resistance of trim circuit 140, and R2 is the resistance of resistor 170. Current I2 is provided to the active circuit element 120, which may be a gain-boosting two-stage operational amplifier. Such an operational amplifier is described further below in the context of FIG. 3. Currents I1 and I2 are constant or substantially constant. Transistor M1 may be sized large enough to provide both currents I1 and I2. Transistor M1 operates in saturation mode and does not enter the triode region of operation despite PVT variation (variation in process, voltage, temperature).

Resistances provided by $R_{TRIM}$ and $R_2$ act as a voltage divider 192. Trim bits INA, INB, and INC provide adjustment when process corners change (i.e., when PVT variation outside of a 5% range occurs). Trim circuit 140 is described further below in the context of FIG. 2. Trim circuit 140 provides voltage $V_{REF}$ at 5V with 5% tolerance (or some other constant voltage, depending on how reference voltage unit 110 is configured, for varying applications). The tolerance of 5% may correspond to an integrated circuit (IC) supply voltage standard specification.

In the following discussion, active element 120 is described as a gain-boosting operational amplifier, although other configurations may be used. Gain-boosting operational amplifier 120 may increase the impedance of transistor M2 from input voltage $V_{IN}$ without the need for adding any more cascode devices and may provide a good current source to the output. Operational amplifier 120 drives the gate M2-G of transistor M2 and forces the output voltage $V_{OUT}$ to equal $V_{REF}$ (or be nearly equal). Voltage variations at the drain M2-D of transistor M2 (i.e., variations in input voltage $V_{IN}$) consequently affect $V_{OUT}$ less than they otherwise would (i.e., with conventional systems) because gain from the operational amplifier regulates this voltage. The output voltage $V_{OUT}$ may be provided to a load, which may include internal control circuitry.

Response time is an important consideration for voltage regulation. The gain-boosting loop provided by operational amplifier 120 and transistor M2 responds quickly when $V_{IN}$ power is applied. Stability is another consideration related to response time. In some embodiments, a capacitor array 190, which may include multiple parallel capacitors, provides decoupling functionality. Capacitors 190 help stabilize $V_{OUT}$ in the presence of noise from $V_{IN}$ or current ripples emanating from a load current. Similarly, in some embodiments, a capacitor array 180, which may include multiple parallel capacitors, may provide decoupling functionality.

Figure 2:
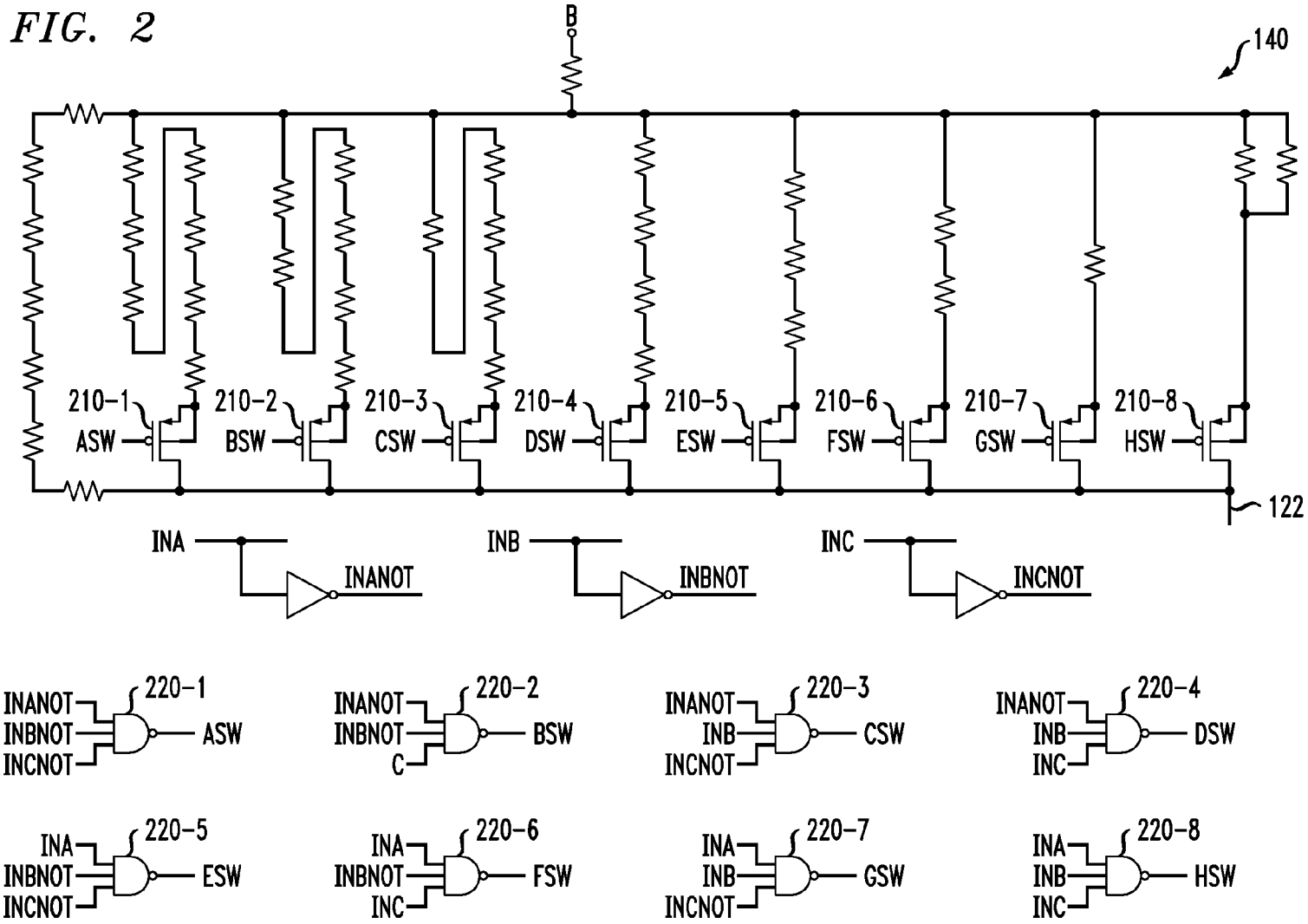
FIG. 2 is a circuit diagram of a trim circuit in accordance with some embodiments.

FIG. 2 is a circuit diagram of a trim circuit in accordance with some embodiments. Trim circuit 140 is a logic circuit that may select between various resistance pathways having different resistances. In the example of FIG. 2, eight resistance pathways having different resistances are provided and are selected based on input signals INA, INB, and INC that control switches 210-1, . . . , 210-8 (collectively 210), which may be PMOS transistors. In this example, various combinations of INA, INB, INC, and their respective complements are provided, via NAND gates 220-1, . . . , 220-8 (collectively 220), to switches 210. One of ordinary skill understands that different numbers of resistance pathways than eight may be used, and different mechanisms may be employed to select between them. Resistance $R_{TRIM}$ provided by trim circuit 140 may adjust current I1. By setting trim inputs INA, INB, and INC appropriately, voltage $V_{REF}$ may be maintained within a range of 5% from a specified value ($V_{OUT}$) in the presence of process corners (as described further below).

Figure 3:
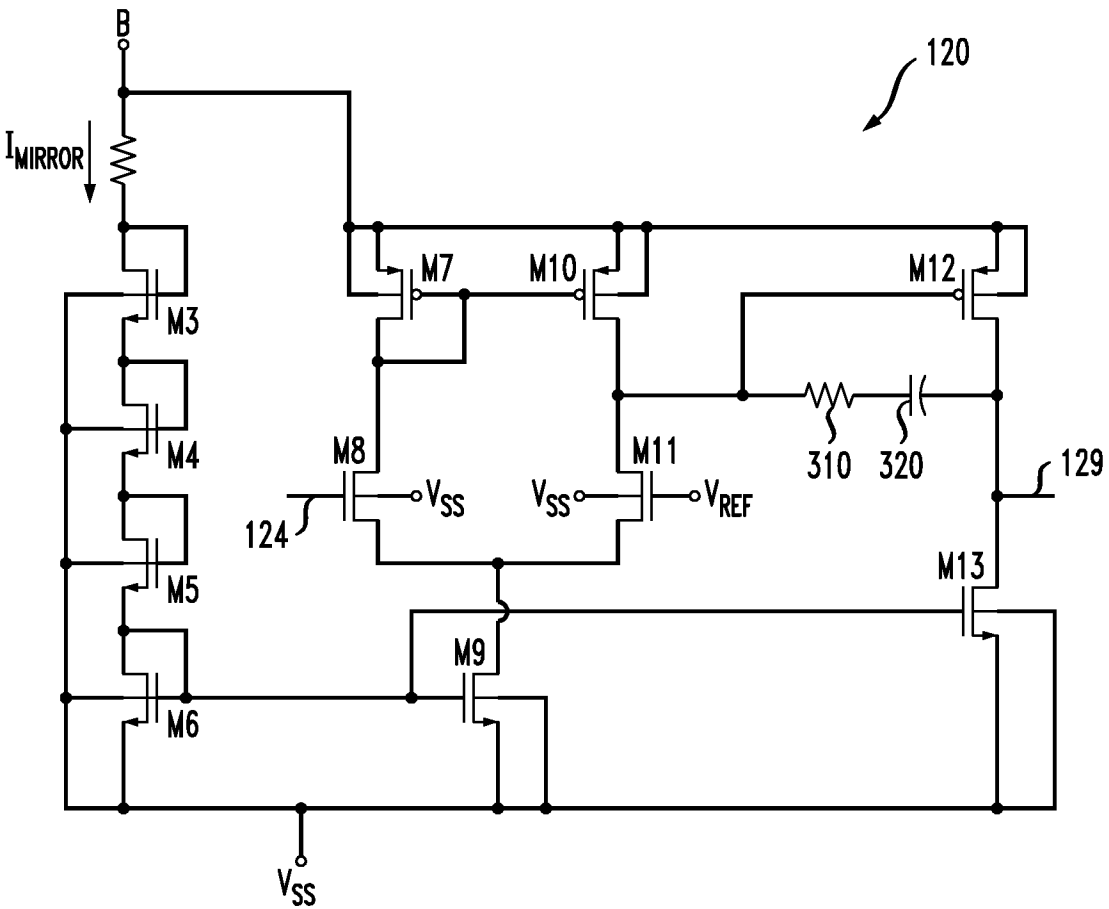
FIG. 3 is a circuit diagram of an active circuit element implemented as a gain-boosting two-stage operational amplifier in accordance with some embodiments.

FIG. 3 is a circuit diagram of an active circuit element implemented as a gain-boosting two-stage operational amplifier 120 in accordance with some embodiments. Amplifier 120 may be a conventional gain-boosting amplifier. Differential gain-boosting amplifiers are described at, e.g., U.S. Pat. No. 7,466,198 to Hunter, which is incorporated herein by reference in its entirety. FIG. 3 shows an example circuit structure as disclosed in many references, e.g., Razavi, Design of Analog CMOS Integrated Circuits, McGraw-Hill ISBN 0-07-118839-8, p. 308 (2001), or Allen and Holberg, CMOS Analog Circuit Design, Oxford University Press, ISBN 0-19-511644-5, p. 258 (2002). A differential input pair is provided by signals $V_{REF}$ and 124. Positive and negative power supply inputs are provided by nodes B and $V_{SS}$, respectively. Transistors M3, . . . , M13 may be arranged in a conventional gain-boosting amplifier configuration, with current mirror $I_{MIRROR}$ providing a gain boosting operational amplifier reference current. Gain and phase are based on this mirror current.

Embodiments have been tested using the Taiwan Semiconductor Manufacturing Company (TSMC) 0.25 micron bipolar CMOS diode (Bipolar-CMOS-DMOS) (BCD) 60V silicon process under various process corners. In the discussion of test results that follows, an output voltage of 5V was used, although other output voltages may be used as well as described above.

With $V_{IN}$=60V, temperatures ranging from −40 to 150 degrees celsius, and various process corners, the following results in Table 1 were obtained for $V_{OUT}$ and $V_{REF}$. Each cell in Table 1 is presented in the form "X-Y" where X is the voltage at −40 degrees celsius and Y is the temperature at 150 degrees celsius. For example, the cell in Table 1 corresponding to $V_{OUT}$ and TT is "5.01V-5.18V", which means that $V_{OUT}$=5.01V when temperature=−40 degrees celsius and $V_{OUT}$=5.18V when temperature=150 degrees celsius.

TABLE 1

$V_{IN}$ = 60 V, temperature variation from −40 to 150 degrees celsius

| | TT | FF | SS |
|---|---|---|---|
| $V_{OUT}$ | 5.01 V-5.18 V | 5.3 V-5.52 V | 5.17 V-5.215 V |
| $V_{REF}$ | 5.01 V-5.18 V | 5.3 V-5.52 V | 5.17 V-5.215 V |

With $V_{IN}$=48V, temperatures ranging from −40 to 150 degrees celsius, and various process corners, the following results in Table 2 were obtained for $V_{OUT}$ and $V_{REF}$.

TABLE 2

$V_{IN}$ = 48 V, temperature variation from −40 to 150 degrees celsius

| | TT | FF | SS |
|---|---|---|---|
| $V_{OUT}$ | 4.94 V-5.06 V | 5.21 V-5.38 V | 5.116 V-5.112 V |
| $V_{REF}$ | 4.94 V-5.06 V | 5.21 V-5.38 V | 5.116 V-5.112 |

With $V_{IN}$=10V, temperatures ranging from −40 to 150 degrees celsius, and various process corners, the following results in Table 3 were obtained for $V_{OUT}$ and $V_{REF}$.

TABLE 3

$V_{IN}$ = 10 V, temperature variation from −40 to 150 degrees celsius

| | TT | FF | SS |
|---|---|---|---|
| $V_{OUT}$ | 5.156 V-4.91 V | 5.25 V-5.0 V | 5.02 V-4.77 V |
| $V_{REF}$ | 5.156 V-4.91 V | 5.25 V-5.0 V | 5.02 V-4.77 V |

Thus, stable voltage regulation ($V_{OUT}$ substantially at 5V, e.g., with 5% tolerance) is observed across a variety of temperatures and process corners.

Figure 4A:
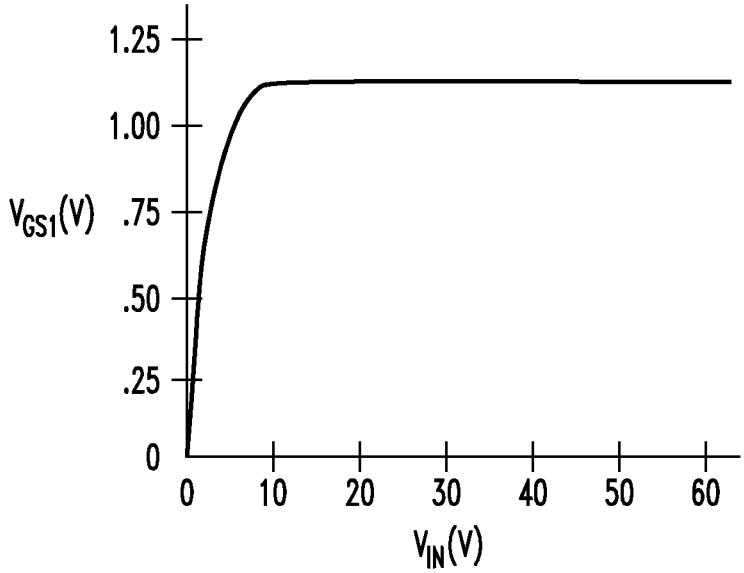
FIGS. 4A-B are voltage plots associated with a transistor in accordance with some embodiments: A) gate-to-source voltage; B) drain-to-source voltage
Figure 4B:
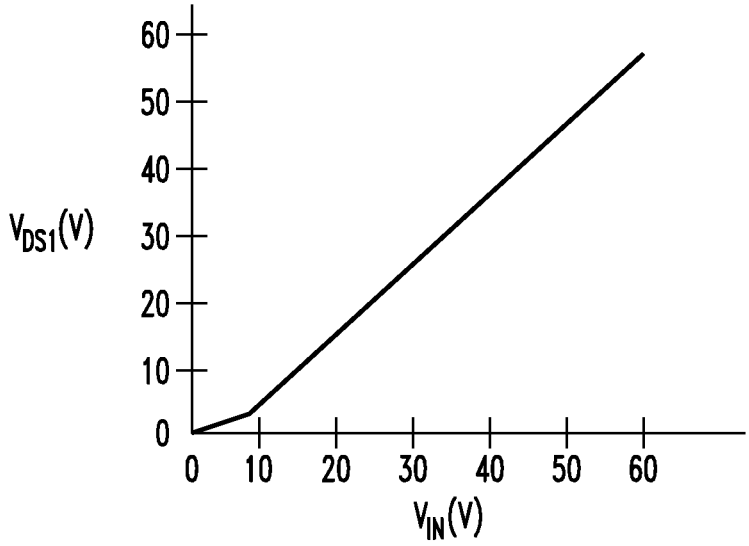

FIGS. 4A-B are voltage plots associated with a transistor in accordance with some embodiments: A) gate-to-source voltage; B) drain-to-source voltage. In FIG. 4A, gate-to-source voltage $V_{GS1}$ of transistor M1 is plotted with input voltage $V_{IN}$ ranging from 0V to 60V, at a temperature of 27 degrees celsius and typical corners; in FIG. 4B, drain-to-source voltage $V_{DS1}$ of transistor M1 is plotted under similar conditions. FIG. 4A shows that $V_{GS1}$ is nearly constant when $V_{IN}$ is between 10V and 60V. FIG. 4B shows that $V_{GS1}$ varies linearly over this range of input voltages. $V_{DS1}$ varies because $V_{IN}$ varies and the voltage at reference node A is substantially constant. Behavior similar to FIGS. 4A-B has been observed at slow and fast process corners.

Figure 5:
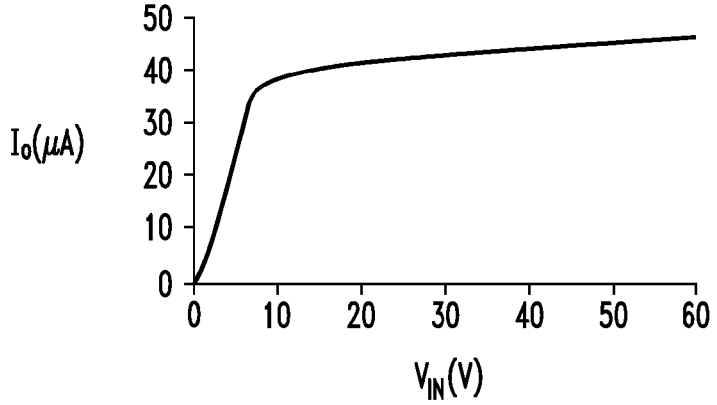
FIG. 5 is a current plot associated with a transistor in accordance with some embodiments.

FIG. 5 is a current plot associated with a transistor in accordance with some embodiments. The current I0 at the source of transistor M1 is plotted with input voltage $V_{IN}$ ranging from 0V to 60V, at 27 degrees celsius and typical corners. FIG. 5 shows that over a wide range of input voltages $V_{IN}$, current I0 is substantially constant. As a result, $V_{REF}$ is substantially constant, and $V_{OUT}$ is also substantially constant, as described above. Behavior similar to FIG. 5 has been observed at slow and fast process corners.

Figure 6A:
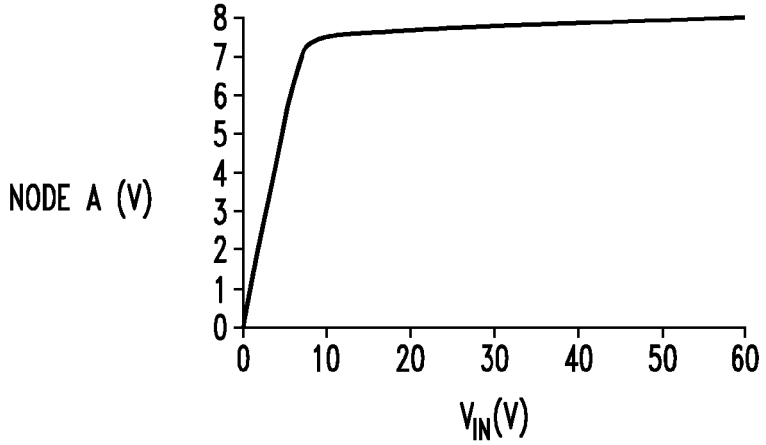
FIGS. 6A-B are voltage plots associated with nodes of a voltage regulator circuit in accordance with some embodiments: A) voltage at a gate of a first series regulator; B) voltage at a source of the first series regulator.
Figure 6B:
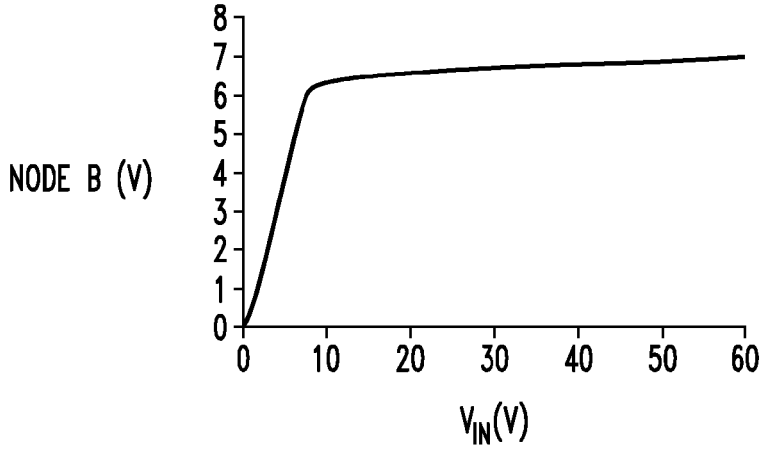

FIGS. 6A-B are voltage plots associated with nodes of a voltage regulator circuit in accordance with some embodiments: A) voltage at a gate of a first series regulator (node A of FIG. 1); B) voltage at a source of the first series regulator (node B of FIG. 1). In both plots, a temperature of 27 degrees celsius and typical corners were used. In FIG. 6A, voltage at node A is substantially constant over a wide range of input voltages $V_{IN}$, e.g., between 10V and 60V; a similar result holds for FIG. 6B and the voltage at node B. For example, FIG. 6B shows that node B exhibits a slope of about (7.0V-6.4V)/(60V-10V)=1.2% over a range of input voltages $V_{IN}$ from 10V to 60V, i.e., substantially constant voltage at node B. Thus, embodiments advantageously provide a substantially constant voltage $V_{REF}$, based on node B, to one input of operational amplifier 120, and feedback to another input 124 enables the operational amplifier 120 to drive transistor M2 to yield a substantially constant output voltage $V_{OUT}$ at the source M2-S of transistor M2. Behavior similar to FIGS. 6A-B has been observed at slow and fast process corners.

In some embodiments, a voltage regulator has a reference voltage unit, first and second transistors, and an active circuit element. The reference voltage unit is configured to provide a substantially constant voltage signal at a reference node. The first transistor is coupled to the reference node and to an input node having an input voltage (e.g., a variable input voltage). The active circuit element is coupled to the first transistor. The second transistor has a source coupled in feedback configuration to a first input of the active circuit element, a drain coupled to the input node, and a gate configured to be driven by the active circuit element to force the source to a voltage about equal to a voltage of a second input of the active circuit element independent of the input voltage.

In some embodiments, a voltage regulator has a reference voltage unit, first and second semiconductor junctions, and an active circuit element. The reference voltage unit is configured to provide a substantially constant voltage signal at a reference node. The first semiconductor junction is coupled to the reference node and to an input node having an input voltage (e.g., a variable input voltage). The active circuit element is coupled to the first semiconductor junction. The active circuit element is configured to receive a first input based on an output terminal of the first semiconductor junction. The active circuit element is configured to be powered by an output terminal of the first semiconductor junction. The second semiconductor junction is coupled to the input node and to the active circuit element. The second semiconductor junction is configured to be driven by an output of the active circuit element to maintain, independent of the input voltage, a substantially constant voltage at an output terminal of the second semiconductor junction that is coupled to a second input of the active circuit element.

Figure 7:
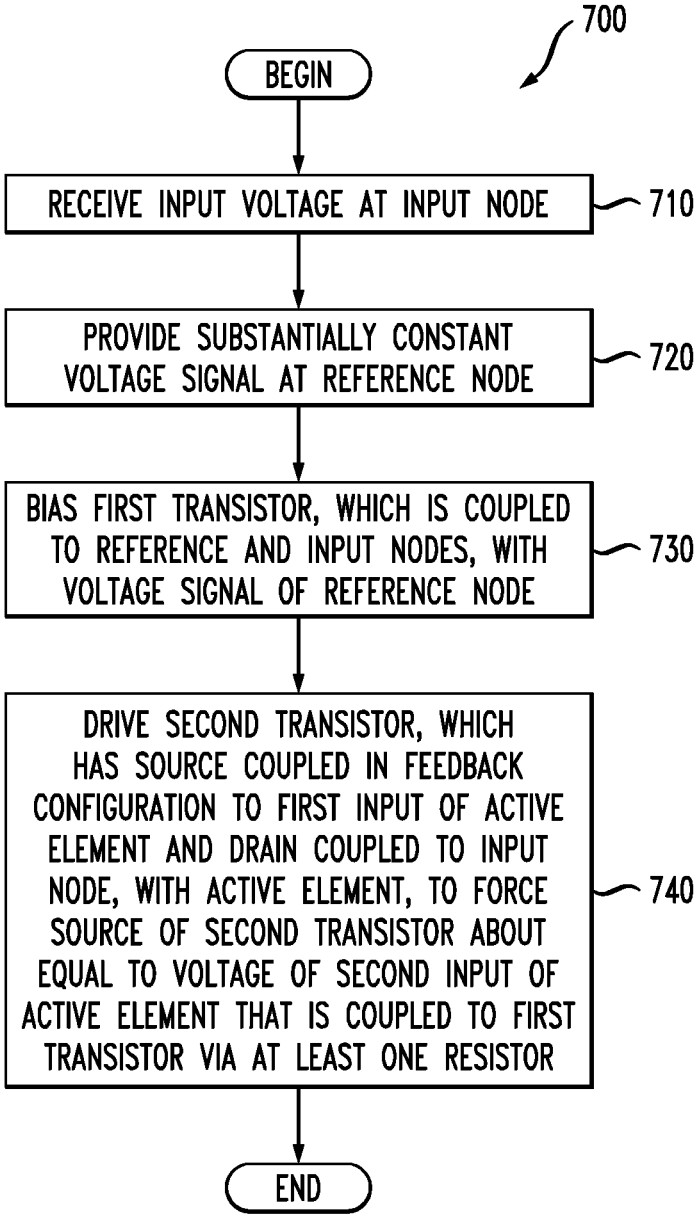
FIG. 7 is a flow diagram of a process in accordance with some embodiments.

FIG. 7 is a flow diagram of a process in accordance with some embodiments. After process 700 begins, an input voltage signal (which may be a variable input voltage signal) is received at an input node at step 710. A substantially constant voltage signal is provided at a reference node at step 720. At step 730, a first transistor that is coupled to the reference node and to the input node is biased with the voltage signal of the reference node. At step 740, a second transistor, which has a source coupled in feedback configuration to a first input of an active circuit element and a drain coupled to the input node, is driven with the active circuit element, to force a source of the second transistor about equal to a voltage of a second input of the active circuit element. The second input of the active circuit element is coupled to the first transistor via at least one resistor.

Although examples are illustrated and described herein, embodiments are nevertheless not limited to the details shown, since various modifications and structural changes may be made therein by those of ordinary skill within the scope and range of equivalents of the claims.

What is claimed is:

1. A voltage regulator comprising:

a reference voltage unit configured to provide a substantially constant voltage signal at a reference node;

a first transistor coupled to the reference node and to an input node having an input voltage, wherein the first transistor is an NMOS transistor;

an active circuit element including a PMOS transistor having a source coupled to a source of the first transistor; and a second transistor comprising a source coupled in feedback configuration to a first input of the active circuit element, a drain coupled to the input node, and a gate configured to be driven by the active circuit element to force the source to a voltage about equal to a voltage of a second input of the active circuit element independent of the input voltage.

2. The voltage regulator of claim 1, wherein the input voltage is a variable input voltage.

3. The voltage regulator of claim 1, wherein the reference voltage unit includes at least one diode and at least one transistor coupled in series.

4. The voltage regulator of claim 3, wherein the at least one diode includes at least one zener diode.

5. The voltage regulator of claim 3, wherein the at least one transistor includes at least one bipolar junction transistor.

6. The voltage regulator of claim 3, wherein each said diode has a temperature coefficient of a first sign and each said transistor has a temperature coefficient of a second sign opposite the first sign.

7. The voltage regulator of claim 1, wherein the second transistor is an NMOS transistor.

8. The voltage regulator of claim 7, wherein the first transistor comprises a gate coupled to the reference node, a source coupled to a power supply input of the active circuit element, and a drain coupled to the input node.

9. The voltage regulator of claim 8, further comprising a voltage divider including a resistor and a resistance unit configured to divide the voltage at the source of the first transistor to provide a divided voltage to the second input of the active element, the resistance unit including a plurality of resistance paths between the source of the second transistor and the second input of the active circuit element, at least two of the resistance paths providing different resistances.

10. The voltage regulator of claim 9, further comprising a logic circuit configured to select one of the plurality of resistance paths.

11. The voltage regulator of claim 1, wherein the active circuit element is an operational amplifier.

12. The voltage regulator of claim 11, wherein the operational amplifier is a high gain differential amplifier.

13. The voltage regulator of claim 12, wherein the operational amplifier is a gain-boosting amplifier.

14. The voltage regulator of claim 13, wherein the operational amplifier is a gain-boosting two-stage amplifier.

15. A method for voltage regulation, the method comprising:

receiving an input voltage signal at an input node;

providing a substantially constant voltage signal at a reference node;

biasing a first transistor, coupled to the reference node and coupled directly to the input node, with the voltage signal of the reference node; and driving a second transistor, having a source coupled in feedback configuration to a first input of an active circuit element and a drain coupled to the input node, with the active circuit element, to force the source of the second transistor about equal to a voltage of a second input of the active circuit element coupled to the first transistor via at least one resistor.

16. The method of claim 15, wherein providing the substantially constant voltage signal at the reference node includes providing a voltage drop across at least one diode and at least one transistor coupled in series.

17. The method of claim 16, wherein the at least one diode includes at least one zener diode.

18. The method of claim 15, wherein the first and second transistors are NMOS transistors.

19. A voltage regulator comprising:

a reference voltage unit configured to provide a substantially constant voltage signal at a reference node;

a first semiconductor junction coupled to the reference node and to an input node having an input voltage;

an active circuit element coupled to the first semiconductor junction, the active circuit element configured to receive a first input that is coupled to an output terminal of the first semiconductor junction via a trim circuit configured to provide variable resistance, the active circuit element configured to be powered by the output terminal of the first semiconductor junction; and a second semiconductor junction coupled to the input node and to the active circuit element, the second semiconductor junction configured to be driven by an output of the active circuit element to maintain, independent of the input voltage, a substantially constant voltage at an output terminal of the second semiconductor junction that is coupled to a second input of the active circuit element.

20. The voltage regulator of claim 19, wherein the reference voltage unit includes one or more forward biased semiconductor junctions and one or more reverse biased semiconductor junctions.

* * * * *